US005379087A

United States Patent [19]

Devaney et al.

[11] Patent Number: 5,379,087

[45] Date of Patent: Jan. 3, 1995

[54] PROCESSING APPARATUS

[75] Inventors: Mark J. Devaney; John S. Lercher; Lee F. Frank, all of Rochester; Paul W. Wagner, Holley; Jeffrey L. Helfer, Webster, all of N.Y.

[73] Assignee: Eastman Kodak Company, Rochester, N.Y.

[21] Appl. No.: 54,810

[22] Filed: Apr. 27, 1993

[51] Int. Cl.[6] ..... G03D 13/02

[52] U.S. Cl. ..... 354/331

[58] Field of Search ..... 354/331, 336, 324, 319–323; 134/64 R, 64 P, 122 R, 122 P

[56] References Cited

U.S. PATENT DOCUMENTS

| | | | |
|---|---|---|---|
| 3,662,660 | 5/1972 | Layne | 354/320 |
| 3,689,063 | 9/1972 | Schmidt | 271/51 |
| 3,728,954 | 4/1973 | Everett | 354/339 X |
| 3,747,499 | 7/1973 | Foster | 354/322 X |
| 3,852,789 | 12/1974 | Russell et al. | 354/339 |
| 3,968,510 | 7/1976 | Allen | 354/319 |
| 4,987,438 | 1/1991 | Goto et al. | 354/319 |
| 4,989,028 | 1/1991 | Hall et al. | 354/324 |
| 4,994,840 | 2/1991 | Hall et al. | 354/324 |
| 5,059,997 | 10/1991 | Hall et al. | 354/324 |
| 5,093,678 | 3/1992 | Muller et al. | 354/324 |

*Primary Examiner*—D. Rutledge

*Attorney, Agent, or Firm*—Dana M. Schmidt

[57] ABSTRACT

A processor for processing a photosensitive material. The processor having a housing chamber. At least one modular wall structure is provided for dividing the housing chamber into a plurality of fluid processing chambers. A modular processing device is placed may be placed in at least one of the plurality of fluid processing chambers for circulating a processing fluid placed in said fluid processing chamber.

44 Claims, 7 Drawing Sheets

FIG. 6A
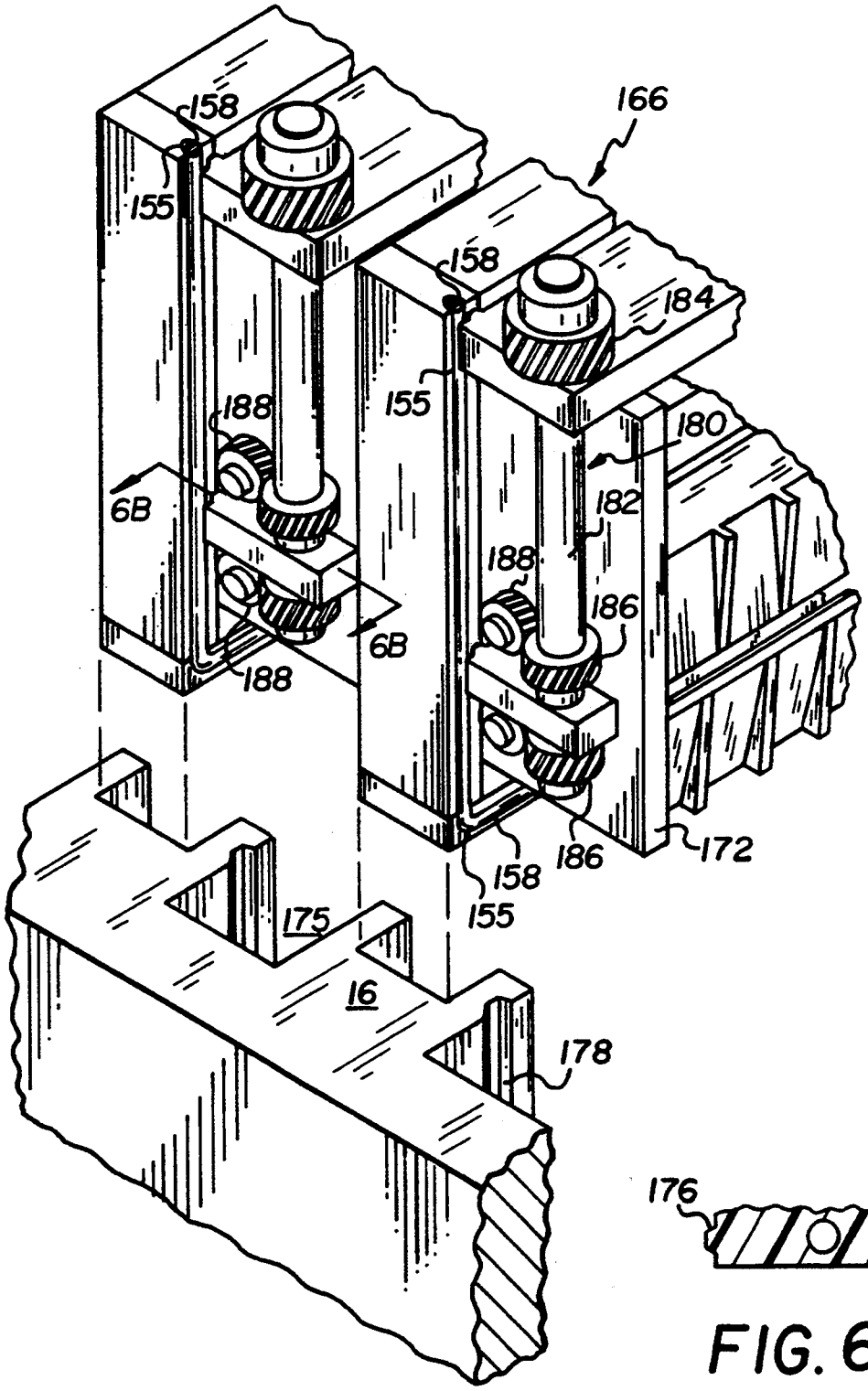
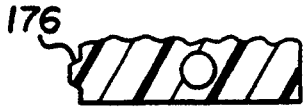
FIG. 6B

PROCESSING APPARATUS

CROSS REFERENCES TO RELATED APPLICATIONS

Reference is made to the following commonly assigned co-pending applications:

1) U.S. Ser. No. 08/054,487, filed concurrently herewith by Mark J. Devaney, Jr. and John S. Lercher, and entitled "Thru-Wall Web Processing Apparatus"; and 2) U.S. Ser. No. 08/054,501, filed concurrently herewith of Mark J. Devaney, Jr. and entitled "Processing Apparatus".

FIELD OF THE INVENTION

This invention relates to the processing of photosensitive material such as photographic film, x-ray, or paper.

BACKGROUND OF THE INVENTION

Manufacturers of photographic processing equipment are continually striving to attain rapid and accurate processing of photographic materials. This equipment should be easily manufactured, reliable and economical. This involves simplifying the design and/or reducing the physical size of various elements in the processor.

In typical prior art processors, a sheet of photosensitive material is passed through a series of open top chambers, each containing a quantity of a processing fluid, by a series of rollers generally centered so that the photosensitive material will pass into and out of each open top chamber. There are a number of disadvantages with respect to processors of this type. First, the lengthy transport path impedes the ability to realize high processing throughput. Exposing of the photosensitive material to atmospheric conditions between the processing chamber is generally not conducive to processing due to the lack of photochemical interaction that takes place during this exposure. Exposure to air can also enhance the breakdown of the processing chemistry. In addition, the photosensitive material is more susceptible to scratching or marring due to the stresses induced as the material remains in substantial contact with multiple sets of rollers required to transverse a serpentine transport path.

Another problem with prior art processors is that each processor is typically designed to be used with a particular type chemistry and/or film. This results in a lack of common parts between processors due to the different requirements required of each processor. Therefore, it is necessary for manufactures and/or distributors to stock a large variety of different parts in order to manufacture and repair various different type processors. Further, designing, redesigning, retrofitting or updating of processors can be quite time consuming and costly. Additionally, due to lack of commonalty, changing production lines from one type processor can require substantial amounts of time and money.

While some attempts have been made to standardize components in certain processors, such as illustrated in U.S. Pat. No. 4,989,028; U.S. Pat. No. 4,994,840; U.S. Pat. No. 5,059,997; and U.S. Pat. No. 5,093,678, these devices are limited in their ability to be interchangeable and modified for different applications.

Applicants have invented an improved processor which is simple in construction, easy to repair and retrofitted, allows for shorter design time and manufacture change over, and which can be easily modified to operate in a variety of configurations and allow interchange ability between various processors such that common subassemblies can be used in a variety of different type processors.

SUMMARY OF THE INVENTION

In accordance with one aspect of the present invention there is provided a processor for processing a photosensitive material. The processor having a housing chamber. At least one modular wall structure is provided for dividing the housing chamber into a plurality of fluid processing chambers. A modular processing device may placed in at least one of the plurality of fluid processing chambers for circulating a processing fluid placed in said fluid processing chamber.

Other objects and advantages will become apparent from the following description presented in connection with the accompanied drawings wherein:

BRIEF DESCRIPTION OF THE DRAWINGS

FIGS. 6A, 6B are enlarged fragmentary exploded perspective view of the other end portions of the modular wall sections and adjacent modular pump sections of FIG. 5A.

DESCRIPTION OF THE PREFERRED EMBODIMENT

In the description that follows use is made of the terms "upper", "lower", "top", "bottom", etc. to facilitate discussion of the present invention. This terminology is used only to provide perspective with respect of the accompanying drawings and is not intended to confine the scope of the present invention described therein.

Figure 1:
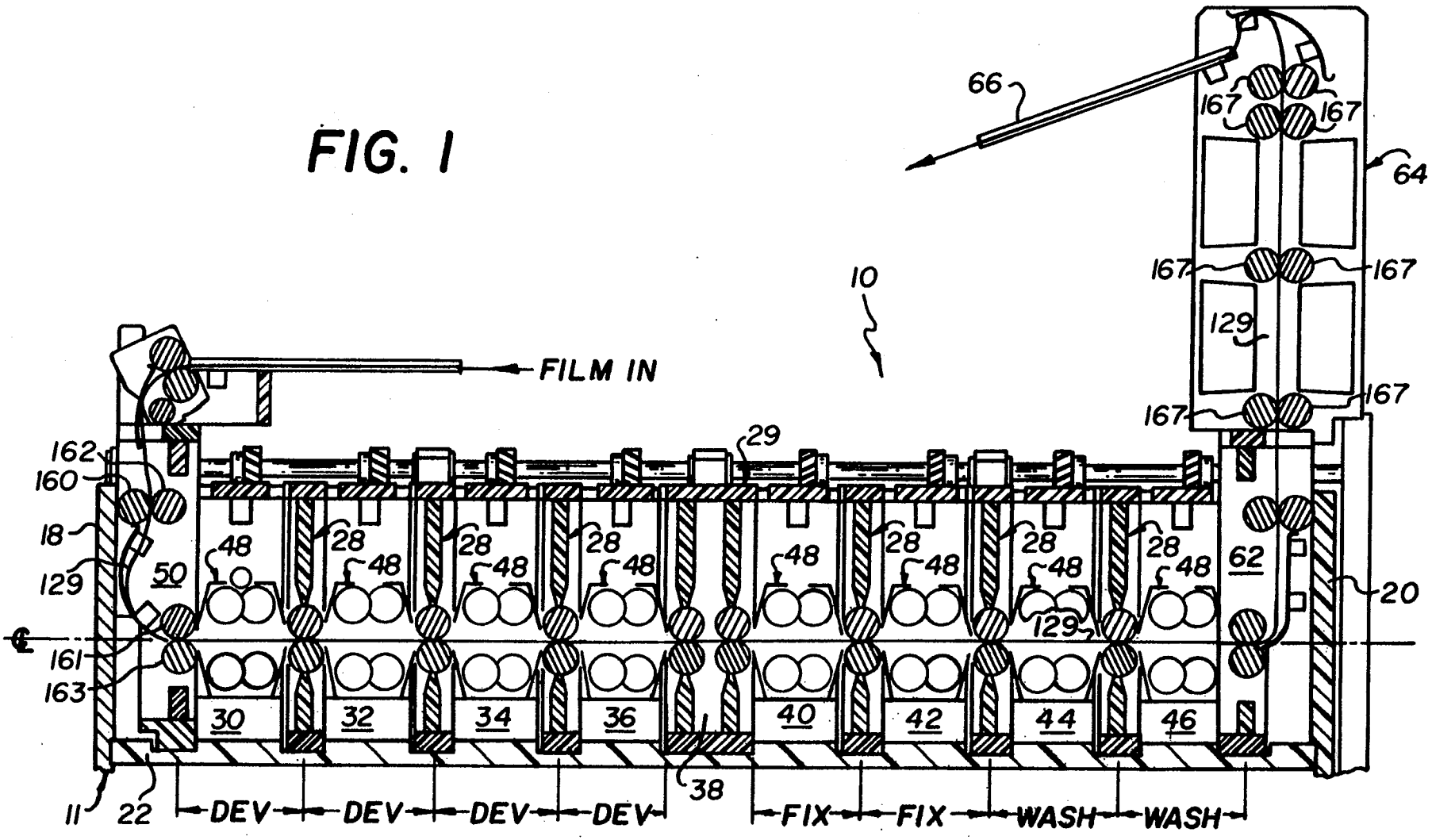
FIG. 1 is a cross-sectional view of a processor made in accordance with the present invention containing a plurality of modular subassemblies.
Figure 2:
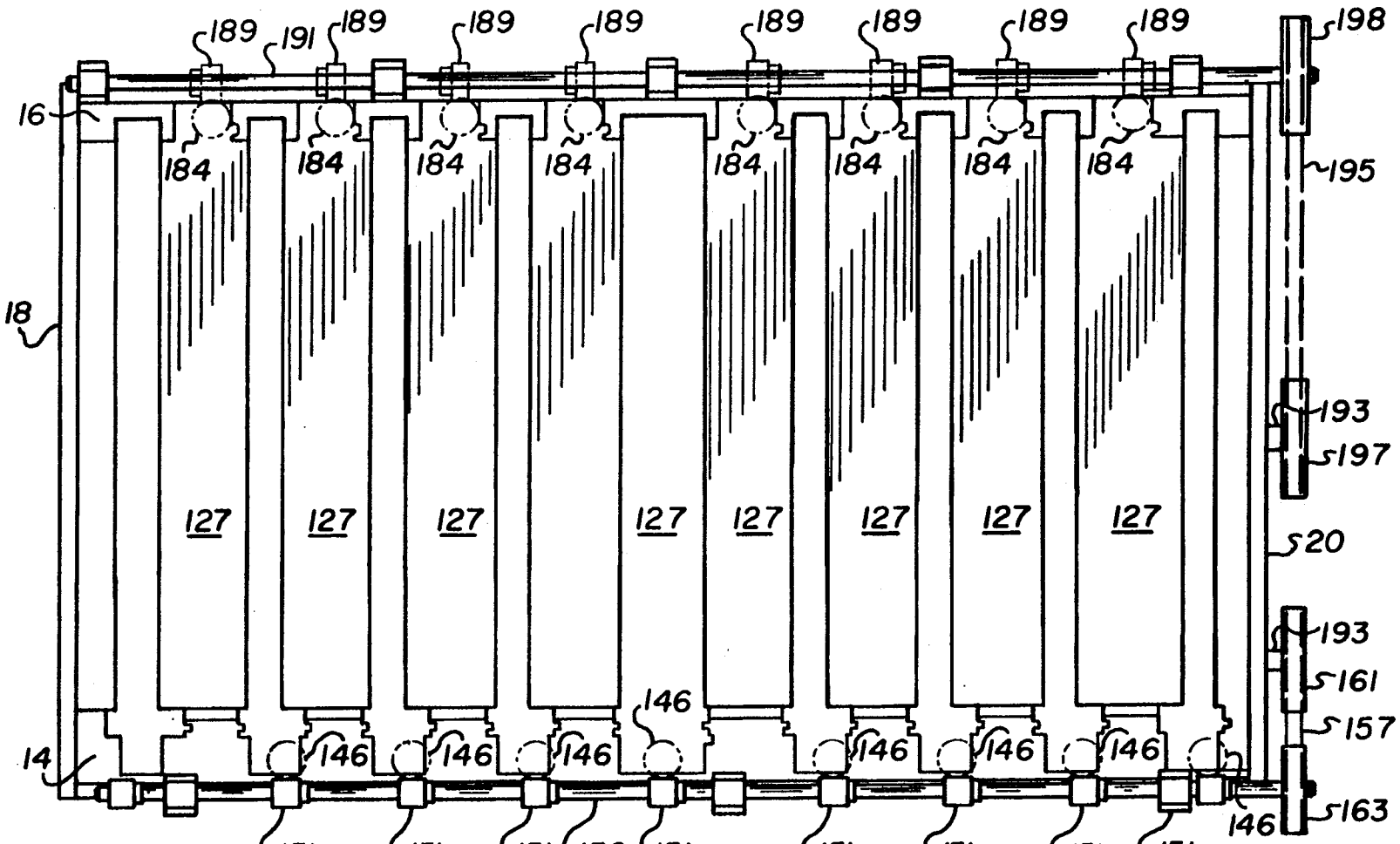
FIG. 2 is a top plan view of the processor of FIG. 1 with modular subassemblies removed.
Figure 3:
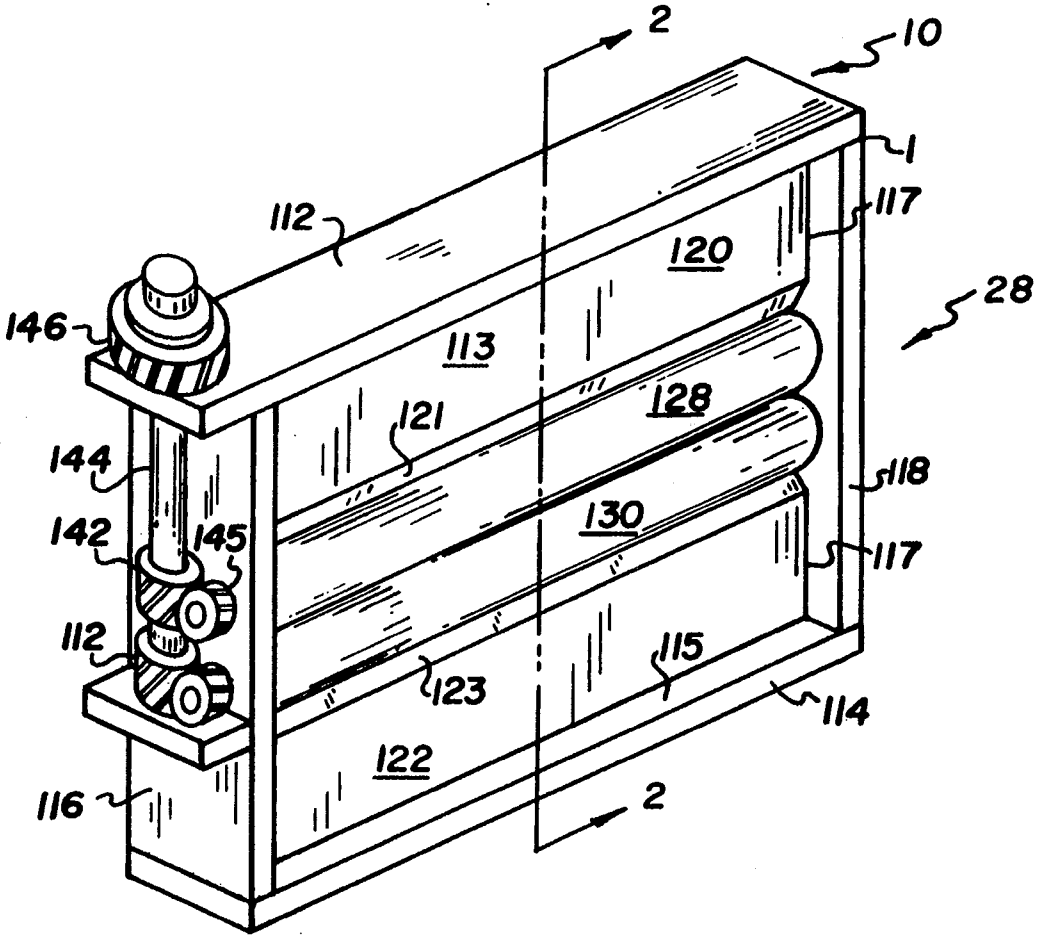
FIG. 3 is a perspective of one of the modular wall section used in the processor of FIG. 1.

Referring to FIGS. 1–3 of the drawings there is shown a processor 10 having a housing 11 which comprises a pair of side walls 14,16, a pair of end walls 18,20 and a bottom wall 22 which form a fluid tight housing chamber 26. In the particular embodiment illustrated, walls 14,16,18,20 and 22 each comprise individual components that are secured together by any desired means, for example by threaded fasteners. However the housing 11 may be fabricated as a single component or as many components as desired. The processor 10 further includes a plurality of modular wall structures 28 which divide the housing chamber 26 into a plurality of fluid processing chambers 30,32,34,36,38,40,42,44,46. Each of the fluid processing chambers 30–46 are capable of holding an appropriate processing fluid. In the particular embodiment illustrated, four fluid processing chambers 30,32,34,36 combine to form the development section of the process which are designed to hold developing processing fluid. In the particular embodiment illustrated, there is illustrated a multistage developing processing system wherein the active component of the processing fluid decreases as the film passes through the processor. However, it is to be understood that any desired number of development processing chambers may comprise the developing section. Applicants have found the use of multistage development processing chambers enhances the chemical utilization efficiency of overall processing of the photosensitive material.

Fluid processing chambers 40,42 define the fix section of the processor and contain processing fluid typically used to fix the photosensitive material. Here, as in the development stage, a co-current multistage process is utilized, however, it is to be understood that any desired number of fixing processing chambers may be provided in the processor.

In the preferred embodiment illustrated, an intermediate processing chamber 38 is provided between the fluid processing chambers containing the development processing fluid and the fixing solution. It is important that no fixing solution contaminate the developing processing solution. Even very small amounts of fixing solution can severely affect the efficiency of the development solution. Intermediate wall assembly 29 is provided for separating fluid processing chambers 36,40 is provided. Modular wall assembly 29 basically comprises a pair of roller wall sections of the modular wall structures 28 which are secured together to form a sealed air chamber 38 therebetween. Preferably as illustrated the chamber 38 is slightly pressurized with air. In particular the embodiment illustrated the chamber 38 is pressurize with about two inches of water pressure. Applicant have found that this small amount of pressure to be sufficient to minimize any leakage from chambers 36,38. Additional intermediate wall assemblies 29 may be utilized at various locations as desired or be entirely omitted.

Processing chambers 44,46 define the wash section of the processor 10 wherein the photosensitive material is washed. In the particular embodiment illustrated, wash water flows from chamber 46 into chamber 44, thus providing a counter current flow for the wash water.

Disposed in each of the development processing chambers 30,32,34,36 there is provided a modular processing module 48 for circulating a processing fluid within the chamber against the photosensitive material passing therethrough. The details of the construction and operation of the fluid processing modules 48 are described in greater detail in copending application Ser. No. 08/054,501, of Mark J. Devaney, Jr., filed concurrently with this application and which is hereby incorporated by reference. In the preferred embodiment illustrated, modules 48 are provided in each of the fluid processing chambers 30,32,34,36. It is, of course, to be understood that modular processing modules 48 need not be provided in each fluid processing chamber. Similar-like processing modules are also provided in chambers 40,42,44,46 for circulating of the respective processing fluid therein against the photosensitive material passing therethrough.

The processor 10 further includes an entrance chamber 50 wherein a photosensitive material is delivered to the first processing chamber 30 and a exit chamber 62 adjacent the last processing chamber 46 for receiving the photosensitive material. A drying module 64 is provided adjacent the exit chamber for receiving a photosensitive material and drying the photosensitive material therein and transporting the photosensitive material onto a receiving tray 66.

The modular wall structures 28 are slideably mounted within housing 12. For the sake of clarity, only one of the modular wall structures 28 will be discussed in detail, it being understood that the other wall structures 28 are similarly constructed. Referring to FIG. 3, the modular wall structure 28 comprises a support frame 110 having a top and bottom support 112,114, respectively, and a pair of side walls 116,118 which are secured together to the top and bottom supports 112,114 to form a substantially rigid structure. In the particular embodiment illustrated, top and bottom supports 112,114 and side walls 116,118 are secured together by thread fasteners. However, various other means may be used for securing these parts together. The support frame 110 is preferably made of a lightweight thermo plastic material. In the particular embodiment illustrated, support frame 110 is made of a standard ABS material (Acrylonitrile-Butadiene-Styrene polymer). The wall structure 28 further includes an upper wall member 120 mounted to lower surface 113 of top support 112 and a lower wall support member 122 mounted to the upper surface 115 of bottom support 114. The ends 117 of each wall member 120,122 are fastened to the interior side of side walls 116,118, by any desired means to provide seal surfaces at their respective interfaces. Additionally, wall members 120,122 are each tapered at their lower and upper ends 121,123, respectively, to form wiping surface 124,126 in opening 125 therebetween. Modular wall assembly 29 is similar in construction to wall structure 28 except that a pair of roller wall sections 120,122 are secured to top, bottom and side walls of frame 110.

As best illustrated by reference to FIGS. 1 and 2, the housing 11 is provided with a plurality of generally U-shaped channels 127 which extends continuously along side walls 14,16 and bottom wall 22 in a direction substantially perpendicular to the path 129 of travel of the film going through the processor. Each channel 127 being designed to receive a modular wall structure 28 or 29.

Figure 5A:
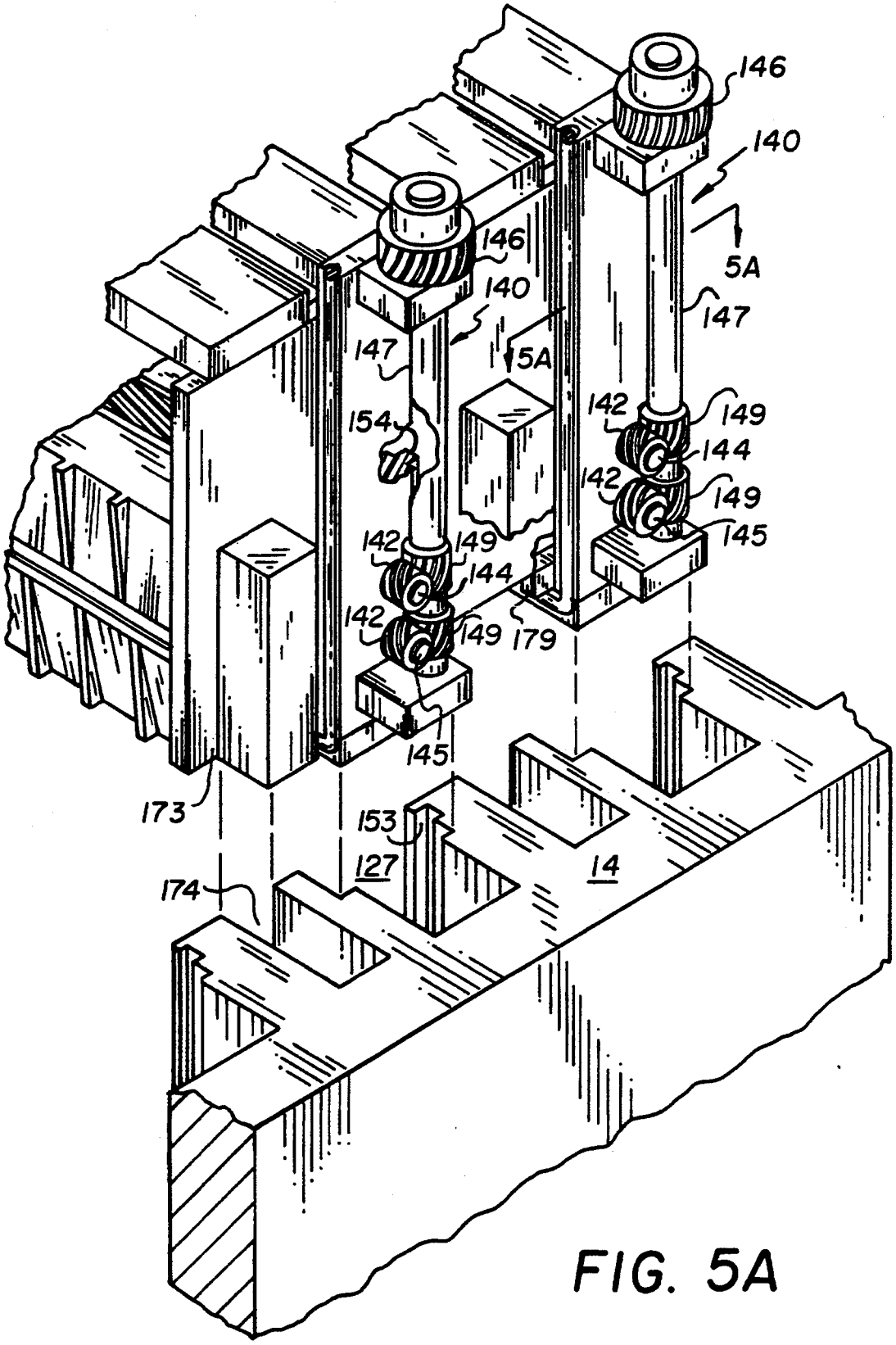
FIGS. 5A, 5B are a enlarged fragmentary exploded perspective view of a portion of the processor of FIG. 3 illustrating the end portions of a pair of modular wall sections and adjacent modular pump sections.
Figure 5B:
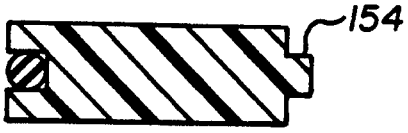

Positioned in the opening provided between wiping surfaces 124,126, as best seen by reference to FIG. 3, there is provided a pair of substantially parallel contacting rollers 128,130. The rollers 128,130 are designed to rotate in such a manner so as to drive a photosensitive material between the rollers 124,126 and through the apparatus. Referring to FIG. 5, rollers 128,130 are driven by a drive train assembly 140 which includes a pair of gears 142 which are connected to shafts 144,145 in rollers 128,130. Drive train 140 further includes a drive shaft 147 rotatably mounted to frame 110. A pair of drive gears 149 are secured to the lower end of shaft 147 which engage gears 142. A take-off drive gear 146 is provided at the upper end of drive shaft 147. The gears 142 are secured to the end of rollers 124,126 such that when shaft 144 is rotated, it will cause the rollers 128,130 to rotate in the desired direction. A primary drive shaft 150 (see FIG. 2) is provided at the upward end of wall 14. A plurality of gears 151 are provided along shaft 156 for engaging and driving gears 146. Modular wall structure 28 is designed so that take-off gear 146 slideably engages its associated gear 151 as modular wall structure is set into the processor. Any appropriate drive means may be connected to shaft 150. In the particular embodiment illustrated, a motor (not shown) having a shaft 193 is connected to shaft 150 by drive belt 157 and pulleys 161, 163. Utilization of vertical shaft 147 for transferring power to the rollers submersed in the processing fluid has the additional advantage of adding very little agitation to the processing fluid. This minimizes exposure of the processing chemicals to air, thereby avoiding undesirable oxidation and reducing the life of the processing chemicals. A discussion of the construction of modular wall structure 28 and its operation is set forth in greater detail copending application of Mark J. Devaney, Jr. and John S. Lercher, previously referred to herein.

One of the side walls 116,118, for example, side wall 116, of the frame 110 is provided with a vertically extended projection 154 (see FIG. 5A) which is designed to slide and mate within a corresponding vertically extending recess 153 provided in the side walls of channel 127. This indexes the modular wall structure 28 with the drive train on housing 11.

The frame 110 is provided with means for providing a sealing relationship with housing 11. In particular, frame 110 is provided a substantially U-shaped recess 155 which extends continuously along side walls 116,118 and bottom support 112 (see FIGS. 5 and 6). Recess 155 is designed to receive an elastomeric gasket 158 having a substantially circular cross-sectional configuration. The gasket 158 is made of a material and sized such that it will form a sealing relationship with the adjacent side of the channel 127 in which side walls are designed to be placed. In the particular embodiment illustrated, gasket 158 is made of silicone rubber having a 40 durometer shore A hardness. A suitable silicone rubber (ASTM D1418) may purchased from Apple Rubber Products, Inc. of Lancaster, N.Y. Installation of the modular wall structure 28 is accomplished by simply sliding the wall structure 28 down into the housing 11. The sealing relationship wall structure forms with housing 11 divides the housing into separate fluid processing chambers. The side walls 116,118 are each slightly tapered such that the upper end is slightly longer than the lower end adjacent the bottom wall so that a small compressive force is applied between the gasket 150 and the adjacent side wall of the channel 127 in which the structure 28 is placed. If and when repair is necessary to either the modular wall structure 28 and/or modular processing module 48, they can simply be removed and replaced by another identical structure.

In the preferred embodiment illustrated, the modular processing modules 48 are identical in design and construction. Therefore, a discussion of only a single modular processing module 48 will be described in detail, it being understood that the other processing modules 48 are likewise constructed. However, it is to be understood that the processing modules 48 placed in the processing chambers need not all be of the same type or of the same construction. The modules 48 need only have a construction such that it can easily slide in and out of it respective chamber.

Figure 4:
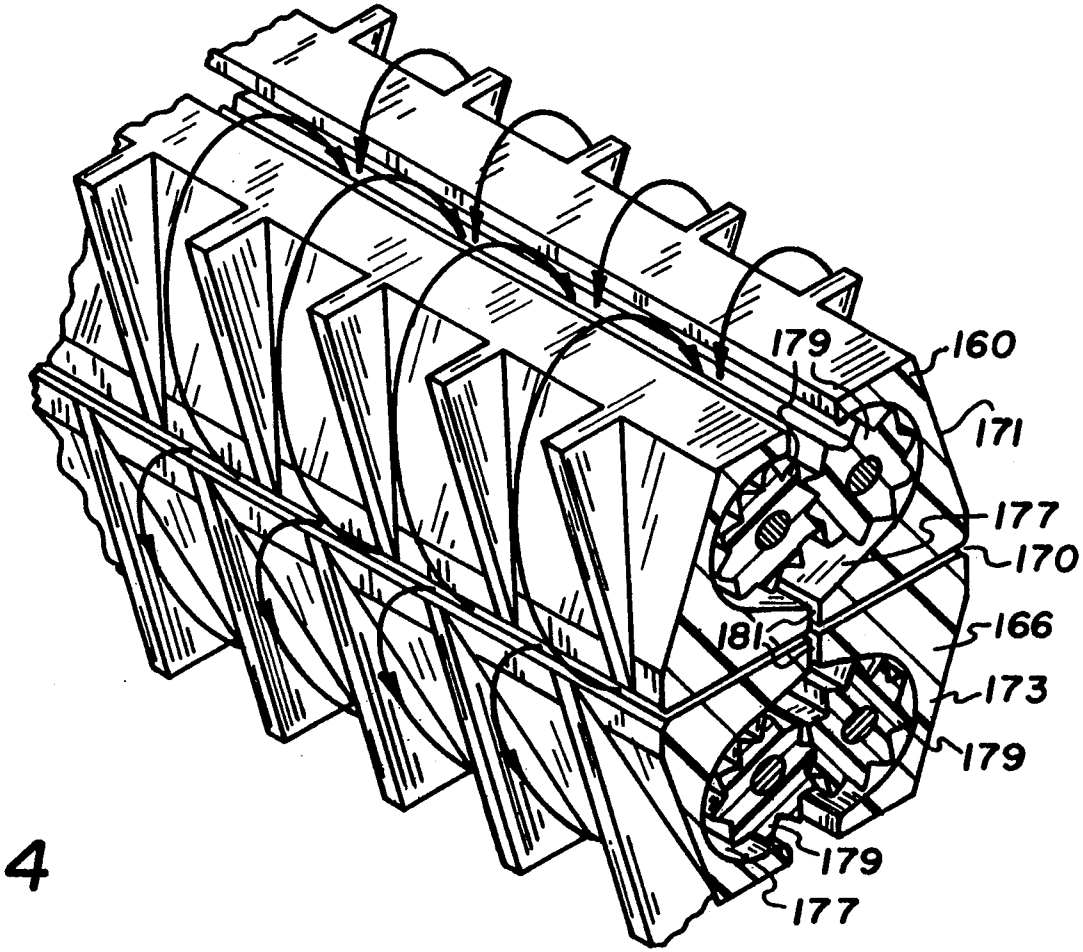
FIG. 4 is partial enlarged perspective view of one of the processing modular sections illustrated in FIG. 1.

Referring to FIGS. 4, 5 and 6, modular processing module forms a channel or recess 170 for receiving of the photosensitive material. In the particular embodiment illustrated, the modular processing module 48 is designed to circulate processing fluid such that the processing fluid will be impinged against the photosensitive material as it passes through the recess 170. Module 48 includes a frame 166 having a top member 169 and a pair of side walls 172, 173. An upper section 171 and lower section 173 are secured to frame 166 which forms the recess 170 for receiving the photosensitive material. Upper and lower sections 171,173 each having a chamber 177 wherein a pair of gears 179 are provided. The rotation of gears 179 cause fluid to enter chamber 177 as indicated by the arrows, and pass through exit 181 to recess 170 and impinge against the photosensitive material. Side walls 172,173 are designed to be received in a pair of oppositely disposed channels 174,175 provided in side walls 14,16 of housing 11. The channels 174,175 are aligned such that the modular processing module 48 extends substantially transversely across the housing chamber. One of the side walls 172,173 of frame 168 is provided with a indexing projection 176 which is designed to mate and slide into a vertically extending recess 178 provided in the adjacent side wall of channel 174 which thereby allows the modular processing module 48 to be properly indexed within the housing chamber 26. As shown in FIG. 6, the opposite side wall 173 of each of the modules 48 is received in channel 174 in the opposite side walls 16 of housing 12. Thus, each processing module 48 is removably supported and aligned in an operative position in its associated processing chamber.

Figure 7:
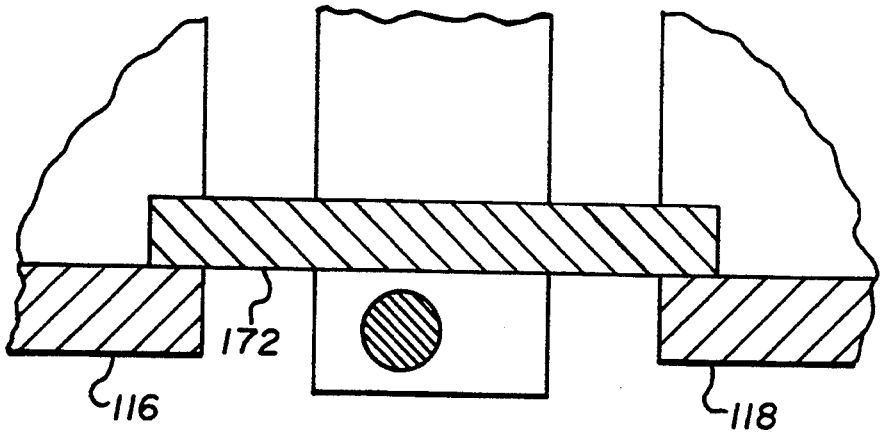
FIG. 7 is a cross-sectional view of the modular wall section and adjacent pump section as taken along line 6—6 of FIG. 6A.

Means are provided for aligning the recess 170 of module 48 with the nip of roller 126,128 of the adjacent wall sections 128. In the particular embodiment illustrated, the bottom of side walls 172 are provided with an indexing block 179 which mates with the surface 115 of bottom wall of the adjacent sections 28. The side wall 173 is similar aligned with the other end of modular wall section 28. As illustrated in FIG. 7, the side wall 172,173 extend adjacent the walls 116,118 of the adjacent wall sections 28. This assists in providing further stability to the modular pump sections 48.

Means are also provided in the processing module 48 for circulating of the processing fluid against the photosensitive material. There is provided means for transferring power to the module 48. In particular, a gear train 180 is provided for transferring power to the module 48. In particular, the gear train includes a rotatably shaft 182 connected to a take-off gear 184 at one end of the shaft 182 and a pair of transfer gears 186 which mesh with corresponding drive gears 188 in module 48. The drive gears 188 are connected to pump gears 179. The take-off gear 184 meshes with a corresponding drive gear 189 secured to primary drive shaft 191 rotatably mounted to the top of side wall 16 (see FIG. 2). Modular processing module 48 is designed such that drive gear 189 slideably engages take-off gear 184 as module 48 is inserted into its associated chamber. Drive shaft 191 is driven by any drive means desired. In the particular embodiment illustrated, drive shaft 191 is driven by motor (not shown) having a drive shaft 193 which is connected to shaft 191 by a connecting drive belt 195 and pulleys 197, 199. The construction and operation of the modular processing module 48 is described in greater detail in copending application of Mark J. Devaney, Jr., previously referred to herein.

Due to the modular construction of the module wall structures 28, intermediate wall assembly 29 and modular processing modules 48, processors of various types and construction can be made simply and easily by simply rearranging the modules within the housing, or simply providing a new housing designed to meet the particular needs of that type processor. For example, in the particular embodiment illustrated, four development processing chambers are shown. However, if so desired, a fewer or greater number of processing chambers may be provided by simply providing a housing having sufficient number of channels to receive the processing module 48 and wall structure 28. Likewise, the desired number of fixing or washing processing chambers may be made to be greater or equal than the preferred embodiment illustrated. This allows a great versatility in the designer in adapting the processor to various chemistries or films that are to be processed in the processor without substantially changing individual component parts, thus requiring a minimal amount of redesigning or fabrication. Likewise, the processor can be easily modified to incorporate modified and/or improved wall structures and/or processing modules without any substantial redesign to the processor. Additionally, time can be saved in changing production lines from producing one type processor to another type.

The processor of the embodiment illustrated provides a simple apparatus which allows the film to travel in a substantially straight path through the processor. A brief discussion of the operation of the processor follows. Referring to FIG. 1, the film enters into chamber 50 and passes through initial pair of rollers 160,162 and then through a second pair of rollers 161,163 into the first modular processing chamber 30 and fluid processing pump 48. Photosensitive material then passes through the rollers in the modular wall structure 28 which are driven by an appropriate source so as to further cause the photosensitive material to travel along the film path 129 illustrated. The photosensitive material continues through each successive fluid processing chamber through the exit chamber 62 and into the dryer 64 by a series of rollers 167 whereupon the photosensitive material is dispensed onto chute 66 at the exit of the dryer.

It is, of course, understood that various other means may be provided for providing of the appropriate driving force through each of the wall structures and processing modules as desired.

While the present invention has been described with regard to the particular embodiment illustrated, it is to be understood that various changes may be made without departing from the scope of the present invention. For example, but not by way of limitation, the photosensitive material need not pass through the wall structure, but may pass over the top edge of the wall as is typically done in prior art processors. This would eliminate the need for rollers and the associated drive system. The present invention being limited by the claims set forth hereafter:

We claim:

1. In a processor for processing a photosensitive material, said processor having a housing chamber, comprising:

at least one modular wall structure for dividing the housing chamber into a plurality of fluid processing chambers; and modular processing means placed in at least one of said plurality of fluid processing chambers for circulating a processing fluid placed in said fluid processing chamber.

2. In a processor as claimed in claim 1 wherein said housing comprises a bottom wall and a pair of opposed substantially parallel side walls, a continuous transverse extending channel is provided along said side walls and bottom for each of said modular wall structures for slideably receiving said modular wall structure and dividing the chamber into said plurality of processing chambers.

3. In a processor as claimed in claim 1 wherein said housing comprises a pair of side walls, one of said side walls having a vertically extending channel positioned so as to slideably receive said modular processing means placed in one of the processing chamber.

4. In a processor as claimed in claim 1 wherein said housing comprises a bottom wall and a pair of opposed substantially parallel side walls, a continuous transverse extending channel is provided along said side walls and bottom for each of said modular wall structures for slideably receiving said modular wall structure and dividing the chamber into said plurality of processing chambers, one of said side walls having a vertically extending channel positioned so as to slideably receive said modular processing means placed in one of the processing chamber.

5. In a processor as claimed in claim 2 wherein said modular wall structure comprises a frame having a bottom wall member, top wall member and a pair of side walls.

6. In an processor as claimed in claim 5 wherein said side walls are provided with means for indexing of said modular wall structure with respect to said side walls of said housing.

7. In a processor as claimed in claim 6 wherein said means for indexing said modular wall structure comprises a projection placed on one end of said side walls of said frame which mates with a corresponding vertically extending recess provided in one of the side walls of said channel for receiving said modular wall structure.

8. In a processor according to claim 5 wherein said frame is provided with a recess which extends continuously along the bottom wall and side wall of said frame, an elastomeric gasket is placed in said recess for providing a fluid sealing relationship between said frame and side wall of the channel in which the frame is placed.

9. In a processor according to claim 5 wherein the side walls of said frame are designed to mate within said channel for slideably receiving said modular wall structure, the upper end of said side walls of said frame having a length greater than the lower end of said side wall.

10. In a processor as claimed in claim 5 further comprising sealing means for providing a fluid seal between said wall structure and said chamber, said sealing means comprising a recess formed in the side walls and bottom wall member of said frame and a gasket placed in said recess such that when said frame is placed in said housing a fluid sealing receiving relationship is formed between said modular wall structure and said housing.

11. In a processor according to claim 4 wherein means are provided for indexing the position of said modular processing means with respect with said modular wall structure.

12. In a processor according to claim 11 wherein said means for indexing the position of the modular processing means with respect with said modular wall structure comprises an indexing block secured to said modular processing means which mates with said modular wall structure.

13. In a processor according to claim 1 wherein said modular wall structure having means for allowing a photosensitive material to pass therethrough.

14. In a processor according to claim 13 wherein said means for allowing a photosensitive material to pass through the modular wall structure comprises a pair of rollers, said frame having a drive assembly for driving said rollers so that said photosensitive material can be driven through the processor.

15. In a processor according to claim 14 wherein said drive assembly slideably engages a drive means secured to the processor for transferring power to said drive assembly.

16. In a processor according to claim 1 wherein said modular processing means includes a drive assembly for circulating said processing solution.

17. In a processor according to claim 16 wherein said drive assembly slideably engages drive means secured to the processor for transferring power to said modular processing means.

18. In a processor for processing a photosensitive material, said processor having a housing chamber, comprising:

a modular wall structure for dividing the housing chamber into a plurality of fluid processing chambers and means for allowing film to pass therethrough;

modular processing means placing at least one of said fluid processing chambers for circulating a processing fluid placed in said fluid processing chamber.

19. In a processor as claimed in claim 18 wherein said housing comprises a bottom wall and a pair of opposed substantially parallel side walls, a continuous transverse extending channel is provided along said side walls and bottom for each of said modular wall structures for slideably receiving said modular wall structure and dividing the chamber into said plurality of processing chambers.

20. In a processor as claimed in claim 18 wherein said housing comprises a pair of side walls, one of said side walls having a vertically extending channel positioned so as to slideably receive said modular processing means placed in one of the processing chamber.

21. In a processor as claimed in claim 18 wherein said housing comprises a bottom wall and a pair of opposed substantially parallel side walls, a continuous transverse extending channel is provided along said side walls and bottom for each of said modular wall structures for slideably receiving said modular wall structure and dividing the chamber into said plurality of processing chambers, one of said side walls having a vertically extending channel positioned so as to slideably receive said modular processing means placed in one of the processing chamber.

22. In a processor as claimed in claim 19 wherein said modular wall structure comprises a frame having a bottom wall member, top wall member and a pair of side walls.

23. In an processor as claimed in claim 22 wherein said side walls are provided with means for indexing of said modular wall structure with respect to said side walls of said housing.

24. In a processor as claimed in claim 23 wherein said means for indexing said modular wall structure comprises a projection placed on one end of said side walls of said frame which mates with a corresponding vertically extending recess provided in one of the side walls of said channel for receiving said modular wall structure.

25. In a processor according to claim 22 wherein said frame is provided with a recess which extends continuously along the bottom wall and side wall of said frame, an elastomeric gasket is placed in said recess for providing a fluid sealing relationship between said frame and side wall of the channel in which the frame is placed.

26. In a processor according to claim 22 wherein the side walls of said frame are designed to mate within said channel for slideably receiving said modular wall structure, the upper end of said side walls of said frame having a length greater than the lower end of said side wall.

27. In a processor as claimed in claim 22 further comprising sealing means for providing a fluid seal between said wall structure and said chamber, said sealing means comprising a recess formed in the side walls and bottom wall member of said frame and a gasket placed in said recess such that when said frame is placed in said housing a fluid sealing receiving relationship is formed between said modular wall structure and said housing.

28. In a processor according to claim 21 wherein means are provided for indexing the position of said modular processing means with respect with said modular wall structure.

29. In a processor according to claim 28 wherein said means for indexing the position of the modular processing means with respect with said modular wall structure comprises an indexing block secured to said modular processing means which mates with said modular wall structure.

30. In a processor according to claim 18 wherein said means for allowing a photosensitive material to pass through the modular wall structure comprises a pair of rollers, said frame having a drive assembly for driving said rollers so that said photosensitive material can be driven through the processor.

31. In a processor according to claim 30 wherein said drive assembly slideably engages a drive means secured to the processor for transferring power to said drive assembly.

32. In a processor according to claim 18 wherein said modular processing means includes a drive assembly for circulating said processing solution.

33. In a processor according to claim 32 wherein said drive assembly slideably engages drive means secured to the processor for transferring power to said modular processing means.

34. In a processor for processing a photosensitive material, said processor having a housing chamber, comprising:

a modular wall structure for dividing the chamber into a plurality of fluid processing chambers.

35. In a processor as claimed in claim 34 wherein said housing comprises a bottom wall and a pair of opposed substantially parallel side walls, a continuous transverse extending channel is provided along said side walls and bottom for each of said modular wall structures for slideably receiving said modular wall structure and dividing the chamber into said plurality of processing chambers.

36. In a processor as claimed in claim 34 wherein said modular wall structure comprises a frame having a bottom wall member, top wall member and a pair of side walls.

37. In an processor as claimed in claim 36 wherein said side walls are provided with means for indexing of said modular wall structure with respect to said side walls of said housing.

38. In a processor as claimed in claim 37 wherein said means for indexing said modular wall structure comprises a projection placed from one end of said side walls to said frame which mate with a corresponding vertically extending recess provided in one of the side walls of said channel for receiving said modular wall structure.

39. In a processor according to claim 36 wherein said frame is provided with a recess which extends continuously along the bottom wall and side wall of said frame, a elastomeric gasket is placed in said recess for providing a fluid sealing relationship between said frame and side wall of the channel in which the frame is placed.

40. In a processor according to claim 36 wherein the side walls of said frame are designed to mate within said channel for slideably receiving said modular wall structure, the upper end of said side walls of said frame having a length greater than the lower end of said side wall.

41. In a processor as claimed in claim 36 wherein sealing means are provided for providing a fluid seal between said wall structure and said chamber, said sealing means comprising a recess formed in the side walls and bottom wall structures of said frame and a gasket placed in said recess such that when said frame is placed in said housing a fluid sealing receiving relationship is formed between said modular wall structure and said housing.

42. In a processor according to claim 34 wherein said wall structure having means for allowing a photosensitive material to pass therethrough.

43. In a processor according to claim 42 wherein said means for allowing a photosensitive material to pass through the modular wall structure comprises a pair of roller, said frame having a drive assembly for driving said roller so that said photosensitive material can be driven through the processor.

44. In a processor according to claim 43 wherein said drive assembly slideably engages a drive means for transferring power to said drive assembly.

* * * * *